United States Patent [19]

Kawasaki

[11] 4,331,523

[45] May 25, 1982

[54] METHOD FOR ELECTROLYZING WATER OR AQUEOUS SOLUTIONS

[75] Inventor: Keiji Kawasaki, Tokyo, Japan

[73] Assignee: Showa Denko KK, Tokyo, Japan

[21] Appl. No.: 247,767

[22] Filed: Mar. 26, 1981

[30] Foreign Application Priority Data

| | | | |
|---|---|---|---|
| Mar. 31, 1980 | [JP] | Japan | 55-40454 |
| Feb. 13, 1981 | [JP] | Japan | 56-18954 |
| Feb. 17, 1981 | [JP] | Japan | 56-20852 |

[51] Int. Cl.[3] ..... C25B 1/04; C25B 1/34; C25B 1/08

[52] U.S. Cl. ..... 204/129; 204/98; 204/128; 204/283; 204/258

[58] Field of Search ..... 204/98, 128, 129, 151, 204/257, 258, 282, 283, 149

[56] References Cited

U.S. PATENT DOCUMENTS

| | | | |
|---|---|---|---|
| 3,459,646 | 8/1969 | Carlson | 204/284 X |
| 3,953,313 | 4/1976 | Levenson | 204/267 |
| 4,124,458 | 11/1978 | Moeglich | 204/301 X |
| 4,172,774 | 10/1979 | Moeglich | 204/296 X |
| 4,242,193 | 12/1980 | Moeglich | 204/301 X |

*Primary Examiner*—R. L. Andrews
*Attorney, Agent, or Firm*—Sherman & Shalloway

[57] ABSTRACT

In a method for electrolyzing water or an aqueous solution using a cation-exchange membrane provided between an anode and a cathode, the improvement wherein one or both of the anode and cathode are composed of a thin layer of an electrically conductive fibrous assembly having a rigid through-hole bearing current collector disposed on its outside surface, and the electrolysis is carried out while maintaining the two electrodes, the cation exchange membrane and the current collectors in the integrally pressed state.

8 Claims, 2 Drawing Figures

METHOD FOR ELECTROLYZING WATER OR AQUEOUS SOLUTIONS

Figure 1:
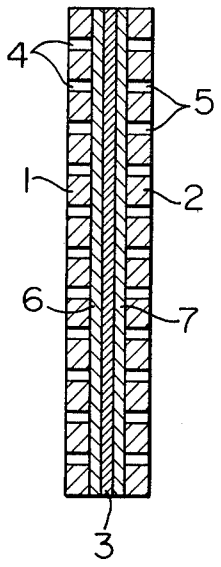

This invention relates to a method for electrolyzing water or an aqueous solution of an alkali metal chloride or the like using an ion-exchange membrane provided between a cathode and an anode.

It is an object of this invention to provide a method by which the aforesaid electrolysis can be performed at a low voltage with reduced power consumption.

The present invention provides a novel method in which the distance between a cathode and an anode can be substantially shortened by holding an ion exchange membrane between the cathode and the anode fixedly and in contact with each other.

The present invention also provides an improvement in the aforesaid novel electrolyzing method, in which the electrolysis voltage can be reduced, and the current efficiency can be increased, by promoting material transfer.

The present invention further provides an improvement in the aforesaid novel electrolyzing method, in which power consumption can be reduced by using an electrode having a low overvoltage.

In the electrolysis of an aqueous solution of an alkali metal chloride or the like using an ion-exchange membrane, the electrolysis voltage and the current efficiency are the major factors which affect power consumption. The electrolysis voltage may be determined by the electrode potential and an electric resistance between electrodes. In other words, the amount of power consumption can be reduced by using an electrode having a low overvoltage and reducing the electrical resistance of the electrolyte solution between the electrodes. The electrical resistance of the electrolyte solution can be reduced by shortening the distance between electrodes.

A so-called ion-exchange membrane method has previously been practised in which an aqueous solution is electrolyzed by using an ion-exchange membrane provided between a cathode and an anode without fixedly securing it in contact with the electrodes, thereby forming a cathode compartment and an anode compartment. The ion-exchange membrane is generally a thin membrane having a thickness of about 100 to about 300 microns which is generally not self-supporting. Accordingly, the membrane frequently sways by the flowing of the electrolyte solution during electrolysis. If the distance between the cathode and the anode is short, a part of the ion-exchange membrane may contact the electrodes, and consequently, a large current will flow at the contacted part and is likely to damage the ion-exchange membrane. Hence, there is a limit to the reduction of the electrolysis voltage by shortening the distance between the electrodes.

Various solutions to this problem have been proposed to date. They include, for example, a method in which a difference in pressure head is provided between the electrolyte solutions in cathode and anode compartments thereby to push the ion-exchange membrane against either one of the electrodes and therefore stop swaying of the ion exchange membrane (Japanese Laid-Open Patent Publications Nos. 68477/1976 and 103099/1976); a method in which the position of the ion-exchange membrane is stably fixed by superimposing it on the surface of one electrode and filling electrically conductive discrete particles between the ion-exchange membrane and the other electrode (Japanese Laid-Open Patent Publication No. 17375/1979); a method in which the ion-exchange membrane is held between electrode plates whose surfaces are so finished as to have a high level of smoothness (Japanese Laid-Open Patent Publications Nos. 47877/1979, 60295/1979 and 88898/1979); and a method in which a plastic spacer is provided between the ion-exchange membrane and the surface of each electrode (Japanese Laid-Open Patent Publication No. 77285/1979).

None of these prior methods, however, have been fully conducive to the reduction of the electrolysis voltage, and the method of fixing the ion-exchange membrane gives rise to various problems. For example, in the method utilizing the difference in pressure head, there is a difference in the pressure exerted on the ion-exchange membrane between the upper part and the lower part of the electrolyte solution, and it is difficult to maintain the difference in head pressure constant. Since variations in the difference in pressure head are liable to cause swaying of the ion-exchange membrane, there is a limit to the shortening of the interelectrode distance. The method involving filling the discrete particles has many defects. For example, handling of the discrete particles during the assembling and disassembling of the electrolysis cell is troublesome. Creases are liable to form in the ion-exchange membrane because in closely filling the particles, a force in a direction to deviate the ion-exchange membrane is generated. If the space for filling is narrow, it is difficult to fill the particles uniformly in this space. Moreover, because gases generated do not escape through the rear surface of the layer of the filled particles but leave directly from the particle layer, the electrolysis voltage will increase owing to the gas gap. On the other hand, the method involving holding the ion-exchange membrane between the electrodes has the disadvantage that if the surface areas of the electrodes are large, it is difficult in practice to increase the precision of smoothing of the electrode surfaces to such an extent as to enable the two electrodes to be uniformly mated with each other, and also to prevent torsional deformation of the two electrodes. In the case of utilizing spacers, the current density on the electrode surfaces varies owing to the area occupied by the spacers. Furthermore, the presence of a non-conductive material such as a plastic net over the entire surfaces of the ion-exchange membrane and the electrode surfaces tends to permit residing of generated gases, and since the interelectrode distance increases, the effect of reducing the electrolysis voltage is reduced.

The present inventor has made investigations in order to solve these problems, and has succeeded in effectively reducing the electrolysis voltage by substantially shortening the interelectrode distance.

Thus, the present invention provides, in a method for electrolyzing water or an aqueous solution using a cation exchange membrane provided between an anode and a cathode, the improvement wherein one or both of the anode and the cathode are composed of a thin layer of an electrically conductive fibrous assembly having a rigid through-hole bearing current collector disposed on its outside surface, and the electrolysis is carried out while maintaining the two electrodes, the cation exchange membrane and the current collector in the integrally pressed state.

According to the method of this invention, a thin layer of an electrically conductive fibrous assembly and a current collector are provided on at least one side of the ion-exchange membrane, and during electrolysis, are maintained in the integrally pressed and tightened state. Since the ion-exchange membrane is fixedly secured in contact with the electrodes, it is prevented from swaying by the flow of the electrolyte solution. Furthermore, localized flowing of a large current can be prevented because the entire surface of the thin layer of an electrically conductive fibrous assembly is pressed against the ion-exchange membrane substantially uniformly. Gases generated are prevented from staying because they are discharged outside through the interstices among the fibers of the fibrous assembly. Thus, the method of this invention enables the distance between the electrodes to be substantially fully shortened while eliminating the aforesaid defects of the prior methods, and electrolysis can be carried out at low voltages.

The electrically conductive fibrous assembly may be provided on both sides of the ion-exchange membrane as an anode and a cathode. It is also possible to provide it only on one side of the ion-exchange membrane and to use a conventional electrode material as an electrode on the other side. When the electrically conductive fibrous assembly is to be provided only on one side of the ion-exchange membrane, it is preferably used as the cathode, and an open-porous plate having a smooth surface is used as the anode.

The thin layer of the electrically conductive fibrous assembly used in this invention is a thin layer of an electrically conductive material having corrosion resistance against gases generated by electrolysis or against the electrolyte solution, or a thin layer of a fibrous assembly coated with the aforesaid material. The assembly may be an elastic sheet-like material such as a cotton-like web, a felt, a low-density web sintered material, a woven fabric or a mesh. The term "web", as used herein, denotes a cotton-like web obtained by processing fibers cut to suitable lengths in a fiber spreading machine. The felt denotes a web obtained, for example, by needle-punching the aforesaid web to strengthen the fiber entanglement. The low-density sintered web denotes an elastic sintered body obtained by sintering the aforesaid web in the lightly compressed state to bond the fibers to each other.

The performance of the aforesaid fibrous thin layer is affected by its basis weight ($g/cm^2$) and its thickness (mm) after press-tightening. When the thickness of the thin layer after press-tightening is small, too small a basis weight decreases the uniform close adhesion of the ion-exchange membrane, and too large a basis weight leads to the need for a higher pressure force and is liable to damage the ion-exchange membrane. On the other hand, when the thickness of the thin layer after pressing is large, too small a basis weight tends to cause a gas gap which results in an increased electrolysis voltage. Too large a basis weight, on the other hand, is insignificant both technically and economically. In other words, this inevitably results in the increased amount of the fibrous material used and in the formation of a gas gap.

Furthermore, since a problem of electric conductivity and a problem of gas residence tend to arise when the fibrous assembly is in the weakly pressed state, it is necessary to press the fibrous assembly fully and use it in the form of a thin layer.

Suitable pressing conditions can be easily determined by simple preliminary experiments. Usually, it is convenient to press a fibrous assembly having a thickness of 5 to 100 mm to a thickness of about 0.1 to about 5 mm. In order to maintain the thickness of the fibrous assembly layer constant with good reproducibility, it is convenient to provide a spacer of a corrosion-resistant metal or a synthetic resin around the assembly when applying the assembly to the ion-exchange membrane.

The electrically conductive material suitable for use as the fibrous material is preferably iron, nickel, an alloy containing at least one of iron and nickel, or a platinum-group metal when it is used as a cathode. Platinum-group metals, oxides of the platinum-groups metals, and carbon are among suitable fibarous materials to be used as an anode. Titanium, titanium alloys, niobium, and tantalum can also be used as the anode, but these metals are preferably used in a form coated with platinum-group metals or the oxides thereof because they are not entirely well conductive and generally have high overvoltages.

The average fiber diameter of the fibrous material is about 5 to about 100 microns, preferably 5 to 50 microns.

A material having a low overvoltage can be coated on the surface of the electrically conductive fibrous assembly used in this invention. This is effective for saving power consumption further.

It is well known that the overvoltages of the cathode and/or the anode greatly affect power consumption, and minimization of the overvoltage of each of the electrodes is important. Of course, it is advantageous to reduce the overvoltage of the electrically conductive fibrous assembly. Choice of an electrically conductive fibrous assembly having a low overvoltage is not easy. For example, an electrically conductive fibrous assembly made of a platinum-group metal having a low overvoltage is not easy to produce, and is costly. Hence, it is economically disadvantageous, and does not serve practical purposes. It is advantageous therefore to coat the fibrous assembly layer with a electrically conductive material having a low overvoltage. This is inexpensive and feasible in practical applications because conventional materials having durability against the electrolyte solution can be used to make the fibrous assembly layer.

Coating may be applied to the fibrous material constituting the assembly or to the fibrous assembly.

First, the coating of the fibrous material constituting the fibrous assembly is described. According to this method, the entire surface of the constituent fibers of the fibrous assembly as a cathode or an anode is coated. The method of coating is not restricted in particular, but electroless plating and heat-decomposition coating are the preferred techniques.

Electroless plating is a method whereby a reducing agent is added to an aqueous solution of a metal salt to deposit the metal. By maintaining a well stirred condition, the plating bath permeates the interstices of the fibrous material fully and is deposited on the surfaces of the individual fibers. For example, if nickel containing boron is deposited by reducing a nickel salt with sodium borohydride, a coated fibrous material suitable as the cathode can be obtained because the plated layer has a low hydrogen overvoltage.

The heat-decomposition coating is a method whereby a solution of a metal salt, etc. is coated, dried and baked to deposit the metal or metal oxide. This method is also very easily applicable to the surface of the individual fibers of the fibrous assembly.

For example, a coated fibrous material having a low hydrogen and chlorine overvoltage and being suitable as a cathode or anode can be obtained by repeating several times a procedure of dipping a fibrous material in an alcohol solution of a chloride of a platinum-group metal, drying and baking the coating.

The coating of the thin layer of fibrous assembly is not the coating of the constituent fibers, but the coating of the surface of the thin layer of a fibrous assembly such as a web or felt. The method of coating in this case is neither restricted in particular. Preferred methods are the hot melt-adhesion or press bonding of fine particles of a substance having a low overvoltage such as a metal or a metal oxide, the heat press-bonding of fine particles of a material having a low overvoltage such as a metal or a metal oxide using fine particles of a thermoplastic polymer such as a fluorocarbon resin as a binder, and the coating, heating, melt-adhesion, etc. of a mixed dispersion or solution of fine particles of a thermoplastic polymer such as a fluorocarbon resin and a material having a low overvoltage such as a metal or a metal oxide. For example, a coated fibrous assembly layer suitable as a cathode having a low hydrogen overvoltage is obtained by mixing a powder of Raney nickel and a dispersion or solution of fluorocarbon resin particles, coating the mixed dispersion to a thin layer of a fibrous assembly, drying the coating, and hot melt-bonding the coating to the thin layer. In this case, a powder of stabilized Raney nickel is preferred, but an undeveloped Raney nickel alloy powder may be used, and developed after coating. The coating may also be performed by electroplating, vapor deposition, and metal powder flame or plasma spraying. Although the entire surface of the fibrous assembly may be coated in such a way, it is sufficient to coat only that surface of the fibrous assembly which makes contact with the ion-exchange membrane. It is also effective to use a combination of a plurality of electrically conductive fibrous assemblies of the same or different configurations. For example, it is possible to coat a thin layer of a mesh-like fibrous assembly, and laying it on a web-like fibrous assembly layer.

As a material having a low overvoltage for use in the coating treatment, there are preferably used platinum-group metals such as platinum, ruthenium, iridium and palladium, and the oxides of these metals, either singly or as mixtures, and solutions capable of forming these materials if it is to be applied to an anode.

When it is to be applied to a cathode, preferred materials having a low overvoltage are platinum-group metals such as platinum, ruthenium, iridium and palladium, the oxides of these metals, either singly or as mixtures, solutions capable of forming these metals and metal oxides, Raney nickel, Raney cobalt, Raney silver, nickel-aluminum alloy, ultrafine nickel powder, nickel boride, and a heat-decomposition product of a nickel salt of a fatty acid.

As stated hereinabove, a fibrous assembly made of such a material as titanium, a titanium alloy, niobium or tantalum as an anode is desirably coated with a platinum-group metal or its oxide to impart low overvoltage and good electric conductivity. The coating of this anode may be performed by the methods described hereinabove.

In a preferred embodiment of this invention, the thin layer of an electrically conductive fibrous assembly has numerous open holes extending therethrough.

As stated hereinabove, the electrolysis voltage and the current efficiency are the major factors which affect power consumption in the electrolysis of water and aqueous solutions, and the electrolysis voltage is mainly dominated by the electrode potential and the electrical resistance of the electrolyte solution.

The electrical resistance of the electrolyte solution can be reduced by decreasing the distance between the electrodes. Since, however, gases are evolved from the electrode surface at the time of electrolysis, the shortening of the interelectrode distance may result, depending upon the configuration of the electrodes, in an increased apparent electric resistance of the electrolyte solution owing to the staying of the generated gases. Thus, in decreasing the interelectrode distance, discharging of the generated gases becomes an important problem.

It is known on the other hand that in the electrolysis of an aqueous solution of an alkali metal chloride, the alkali hydroxide concentration in the cathode compartment is limited when using ion-exchange membranes now generally marketed for use in the electrolysis of aqueous solutions of alkali chlorides, such as "Nafion" (a product of E. I. du Pont de Nemours & Co.), and the current efficiency decreases markedly if the ion-exchange membranes are used at alkali hydroxide concentrations above the limit. This shows that if material transfer is poor and the alkali hydroxide concentration is locallly high on the cathode side of the cation-exchange membrane, the current efficiency is reduced. If material transfer is poor, water electrolysis reaction would take place on the anode surface also on the anode side of the cation exchange membrane, and the current efficiency would be reduced in this case too. The poor material transfer which causes a decrease in current efficiency presumably has to do with the configuration, structure, etc. of the electrodes, and is especially important when the interelectrode distance is small.

The thin layer of an electrically conductive fibrous assembly used in this invention permits some range of material transfer by dint of the interstices among the constituent fibers. However, when the fibrous assembly is pressed to a high degree or the current density is high (although this is desirable as stated hereinabove), material transfer through the fiber interstices is not always sufficient. The provision of through-holes extending through the fibrous assembly has been found to be effective in such a case.

The size of these through-holes is not particularly limited, and may be the one which permit movement of the generated gases and the electrolyte therethrough. For example, in the case of circular holes, their diameter is preferably in the range of 1 to 10 mm. Desirably, the through-holes are distributed uniformly on the entire surface of the fibrous assembly layer.

The provision of the through-holes slightly decreases the effective area of the thin layer of an electrically conductive fibrous assembly as an electrode, but is not disadvantageous because the total area occupying the through-holes needs not to be large. The proportion of the area of the through-holes is usually 10 to 50% in order to produce the above effect, and a proportion of 15 to 30% is sufficient.

The configuration of the holes is not particularly restricted, and may generally be circular or rectangular. The holes may be provided by usual methods such as punching.

A through-hole bearing rigid current collector is provided on the outside of the thin layer of electrically conductive fibrous assembly (i.e., on the side opposite to the ion-exchange membrane). The current collector permits provision of a nearly uniform current distribution over substantially the entire surface of the fibrous assembly, and has the function of urging the fibrous assembly toward the ion-exchange membrane with a nearly uniform force over its entire surface. The area of that part of the current collector which contacts the fibrous assembly is desirably nearly equal to the area of the thin layer of the fibrous assembly.

The current collector may be a porous member such as a wire mesh, a lattice, or a punched metal. To impart rigidity, a reinforcing material having bending resistance may be used to reinforce the current collector.

The current collector may be made of a material whose electric conductivity is at least not lower than that of the fibrous assembly. Examples of the material are titanium and other valve metal substrates coated with platinum, palladium, rhodium, ruthenium and iridium and their oxides either alone or in combination when they are used on the anode side. For use on the cathode side, the material may, for example, be nickel, iron, stainless steel, titanium, and platinum-group metals.

The current collector may be built as a one-piece unit with an end plate of an electrolysis cell or a partitioning wall in a bipolar electrolysis cell. For example it may be made of a plate having lattice-shaped grooves.

The suitable proportion of the area of the through-holes or grooves is about 15 to 80% based on the entire area of the fibrous assembly.

The material of which the cation-exchange membrane is made is not particularly restricted, and for example, fluorine-containing polymers and divinylbenzene-type polymers may be usually employed.

Various methods can be used to maintain the electrodes, the ion-exchange membranes and the current collector in the pressed state. For example, they may be pressed by a spring as a unit. Or they may be pressed as in a filter press. Or an assembly of these may be pressed by using bolts and nuts.

When an aqueous solution of an alkali metal chloride is electrolyzed using the electrically conductive fibrous assembly as the cathode only on one side of the ion-exchange membrane and a conventional electrode on the other side. The anode may be a box-type metallic electrode consisting of a titanium substrate and a platinum-group metal or its oxide coated thereon, and the current collector may be a rigid wire mesh.

The present invention is most preferably applied to the electrolysis of an aqueous solution of an alkali metal chloride, but can also be applied to the electrolysis of other aqueous solutions and water.

In applying the method of this invention to electrolysis of various types of aqueous solutions, it is necessary to insure that the fibrous assembly has durability. For example, when water is electrolyzed using a cation-exchange membrane such as a Nafion membrane, the corroding action of the Nafion membrane having acidity must be considered, and the cathode needs to be made of a corrosion-resistant material such as a platinum-group metal, or titanium, niobium and tantalum coated with a platinum-group metal or its oxide.

Figure 2:
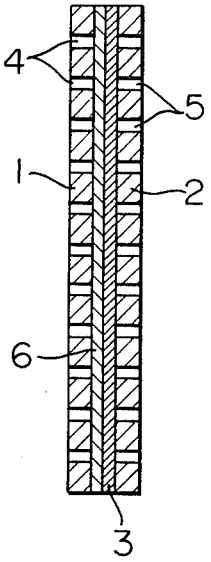

Specific examples of the structure of an electrolysis cell used in this invention are described with reference to the accompanying drawings in which:

FIG. 1 is a cross-sectional schematic view of one embodiment of the electrolysis cell in accordance with this invention, and FIG. 2 is a cross-sectional schematic view of another embodiment of the electrolysis cell in accordance with this invention.

In FIGS. 1 and 2, the thicknesses of the ion-exchange membrane, the electrodes, the fibrous assembly and the current collector are shown exaggeratedly for their lengths.

FIG. 1 shows an example in which a fibrous assembly as an electrode and a current collector are provided on both sides of an ion-exchange membrane. The reference numeral 3 represents the ion-exchange membrane; 6, a cathode made of a thin layer of the fibrous assembly; 7, an anode made of a thin layer of the fibrous assembly; 1, a current collector on the cathode side; 2, a current collector on the anode side; and 4 and 5, through-holes provided in the current collector.

FIG. 2 shows an example in which a fibrous assembly layer as an electrode is provided on the cathode side of the ion-exchange membrane. It is the same as in FIG. 1 except that the anode 7 made of the fibrous assembly layer is not present and 2 represents the anode.

The following Examples illustrate the present invention more specifically. It should be understood that these examples do not limit the scope of the invention.

EXAMPLE 1 AND COMPARATIVE EXAMPLE 1

A cation-exchange membrane of a fluorine-containing resin (Nafion No. 315, a product of E. I. du Pont de Nemours & Co.) was interposed between an anode made of an expanded titanium screen coated with ruthenium oxide and a cathode current collector made of an expanded stainless steel screen, and a thin layer of each of the various electrically conductive fibrous assemblies shown in Table 1 was interposed between the cathode current collector and the ion-exchange membrane. The entire assembly was pressed over its entire surface, and used in building an electrolysis cell.

An aqueous solution of sodium chloride (310 g/liter) was fed into the anode compartment of the electrolysis cell, and deionized water was fed into the cathode compartment. The aqueous solution of sodium chloride was thus electrolyzed at a temperature of 80° C. and a current density of 20 A/dm$^2$. The catholyte had a sodium hydroxide concentration of 20% by weight, and the level of the anolyte was maintained substantially equal to that of the catholyte solution.

The results of the electrolysis under these conditions are shown in Table 1.

For comparison, the electrically conductive fibrous assembly layer was not used and the cathode current collector was used as the cathode, and that the inter-electrode distance was changed to 5 mm and the ion-exchange membrane was fixedly mounted between them. The results are also shown in Table 1 (Comparative Example 1).

TABLE 1

| Run No. | | Thin layer of an electrically conductive fibrous assembly: Material | Configuration | Fiber diameter (microns) | Basis weight (g/cm$^2$) | Approximate thickness of the thin layer after tightening (mm) | Electrolysis voltage (V) |
|---|---|---|---|---|---|---|---|
| Example 1 | (1) | Iron | Web | 25 | 0.04 | 0.15 | 3.25 |
| | (2) | " | " | 25 | 0.12 | 0.3 | 3.24 |
| | (3) | " | " | 25 | 0.27 | 0.5 | 3.20 |
| | (4) | " | " | 25 | 0.46 | 1 | 3.20 |
| | (5) | Stainless steel (SUS-316L) | " | 8 | 0.025 | 0.12 | 3.27 |
| | (6) | Stainless steel (SUS-316L) | " | 8 | 0.05 | 0.25 | 3.29 |
| | (7) | Stainless steel (SUS-316L) | " | 8 | 0.075 | 0.35 | 3.23 |
| | (8) | Stainless steel (SUS-316L) | " | 8 | 0.125 | 0.6 | 3.29 |
| | (9) | Stainless steel (SUS-316L) | Felt | 8 | 0.19 | 1 | 3.26 |
| | (10) | Stainless steel (SUS-316L) | " | 8 | 0.38 | 2 | 3.32 |
| | (11) | Stainless steel (SUS-316L) | " | 8 | 0.57 | 3 | 3.34 |
| | (12) | Stainless steel (SUS-316L) | Low-density sintered body | 8 | 0.025 | 0.6 | 3.41 |
| Comparative Example 1 | (1) | | | | | | 3.77 |

EXAMPLE 2

A thin layer of each of the electrically conductive fibrous assemblies shown in Table 2 was interposed between the cathode current collector and the ion-exchange membrane, and a Teflon spacer having each of the thicknesses shown in Table 2 was placed around the thin fibrous layer in order to maintain the thickness of the thin fibrous layer constant. Otherwise, an electrolysis cell was built, and electrolysis was conducted, in the same way as in Example 1.

The results are shown in Table 2.

Comparative Example in Table 2 show the value obtained in Comparative Example 1.

TABLE 2

| Run No. | | Thin layer of electrically conductive fibrous assembly: Material | Configuration | Fiber diameter (micron) | Basis weight (g/cm$^2$) | Approximate thickness of the layer (mm) | Thickness of the spacer (mm) | Electrolysis voltage (V) |
|---|---|---|---|---|---|---|---|---|
| Example 2 | (1) | Iron | Web | 25 | 0.21 | 1 | 1 | 3.44 |
| | (2) | " | " | 25 | 0.21 | 3 | 3 | 3.45 |
| | (3) | Stainless steel (SUS-316L) | " | 8 | 0.125 | 1 | 1 | 3.45 |
| | (4) | Stainless steel (SUS-316L) | " | 8 | 0.125 | 3 | 3 | 3.48 |
| Comparative Example 1 | (1) | | | | | | | 3.77 |

EXAMPLE 3

A cation exchange membrane of a fluorine-containing resin (Nafion No. 315, a product of E. I. du Pont de Nemours & Co.) was interposed between an anode current collector made of an expanded titanium screen coated with ruthenium oxide and a cathode current collector made of an expanded stainless steel screen. A web of carbon fibers (fiber diameter 0.01 mm, basis weight 0.026 g/cm$^2$) was interposed between the anode current collector and the ion-exchange membrane, and a web of iron fibers (fiber diameter 0.025 mm, basis weight 0.27 g/cm$^2$) was interposed between the cathode current collector and the ion-exchange membrane. The two current collectors were pressed toward the ion-exchange membrane. The resulting assembly was used in building an electrolysis cell.

An aqueous solution of sodium chloride (310 g/liter) was fed into the anode compartment of the electrolysis cell, and deionized water was fed into the cathode compartment. The sodium chloride solution was electrolyzed at a temperature of 80° C. and a current density of 20 A/dm$^2$. The catholyte had a sodium hydroxide solution of 20% by weight, and the level of the anolyte solution was maintained substantially the same as that of the catholyte solution.

As a result of electrolysis under these conditions, the electrolysis voltage was 3.35 V.

EXAMPLE 4

A plurality of through-holes each having a diameter of 6 mm were provided by a punching method in an area ratio of 25% on a web of stainless steel (SUS-316L) fibers having a fiber diameter of 8 microns, a basis weight of 0.075 g/cm$^2$ and a thickness of 20 mm.

A cation-exchange membrane of a fluorine-containing resin (Nafion No. 295 a product of E. I. du Pont de Nemours & Co.) was interposed between an anode made of an expanded titanium screen coated with iridium oxide-platinum and a cathode current collector made of an expanded stainless steel screen. The aforesaid through-hole bearing web was interposed between the cathode current collector and the ion-exchange membrane, and the entire assembly was uniformly pressed so that the thickness of the web layer was reduced to about 0.5 mm.

An aqueous solution of sodium chloride (310 g/liter) was fed into the anode compartment of the resulting electrolysis cell, and electrolyzed at a temperature of 60° C. and a current density of 20 A/dm$^2$ while maintaining the NaOH concentration of the catholyte solution at about 25% by weight. The electrolysis voltage was 3.45 V, and the current efficiency was 88%.

EXAMPLE 5

A plurality of holes having a diameter of 6 mm were provided in a web of stainless steel (SUS-316L) fibers having a fiber diameter of 8 microns and a basis weight of 0.025 g/cm$^2$. Then, the stainless steel web was repeatedly subjected seven times to a heat-decomposition coating procedure consisting of dipping the stainless steel web in an ethanol solution of chloroplatinic acid (platinum content 3 g/liter), withdrawing it, drying it and baking it at 500° C. There was obtained a fibrous assembly (web) for a cathode which consisted of fibers having a platinum coating.

A cation exchange membrane of a fluorine-containing resin (Nafion No. 295 a product of E. I. du Pont de Nemours & Co.) was interposed between an anode made of an expanded titanium screen coated with platinum-iridium oxide and a cathode current collector made of an expanded stainless steel screen. The above stainless steel web coated with platinum and a non-coated web of the same stainless steel fibers having a basis weight of 0.05 g/cm$^2$ were interposed between the cathode current collector and the ion-exchange membrane so that the coated stainless steel web was located facing the ion-exchange membrane. The entire assembly was pressed so that the web layer had a thickness of 0.5 mm. Thus, an electrolysis cell was built.

An aqueous solution of sodium chloride (310 g/liter) was fed into the anode compartment of the electrolysis cell, and deionized water was fed into the cathode compartment. The sodium chloride solution was electrolyzed at a temperature of 60° C. and a current density of 20 A/dm$^2$ while maintaining the concentration of NaOH in the catholyte solution at about 25% by weight. The electrolysis voltage was 3.26 V.

COMPARATIVE EXAMPLE 2

A web of stainless steel (SUS-316L) fibers not coated with platinum was used as the cathode fibrous assembly. Otherwise, an electrolysis cell was built in the same way as in Example 5, and the same electrolysis as in Example 5 was carried out. The electrolysis voltage was 3.45 V.

What we claim is:

1. In a method for electrolyzing water or an aqueous solution using a cation-exchange membrane provided between an anode and a cathode, the improvement wherein one or both of the anode and cathode are composed of a thin layer of an electrically conductive fibrous assembly having a rigid through-hole bearing current collector disposed on its outside surface, and the electrolysis is carried out while maintaining the two electrodes, the cation exchange membrane and the current collectors in the integrally pressed state.

2. The method of claim 1 wherein the cation-exchange membrane, thin layer of the electrically conductive fibrous assembly and a cathode current collector are superimposed in this order on the smooth surface of an anode screen and the entire assembly is pressed as an integral unit, and the electrolysis is carried out using the resulting assembly.

3. The method of claim 1 or 2 wherein the fibrous material constituting the thin layer of the electrically conductive fibrous assembly used as the cathode is made of a material selected from iron, nickel, alloys containing at least one of iron and nickel, and mixtures thereof.

4. The method of claim 1 wherein the thin layer of the electrically conductive fibrous assembly has a number of holes extending therethrough.

5. The method of claim 4 wherein the proportion of the total area of spaces occupied by the through-holes is 10 to 50% based on the entire area of the thin layer of electrically conductive fibrous assembly.

6. The method of claim 1 wherein the electrically conductive fibrous assembly is coated with a material having a low overvoltage.

7. The method of claim 6 wherein the material having a low overvoltage for the anode is selected from the group consisting of platinum, ruthenium, iridium, palladium, the oxides of these metals, and mixtures thereof.

8. The method of claim 6 wherein the material having a low overvoltage for the cathode is selected from the group consisting of platinum, ruthenium, iridium, palladium and the oxides of these metals, Raney nickel, ultrafine nickel, heat-decomposition products of nickel salts of fatty acids, nickel boride, Raney cobalt and Raney silver, and mixtures thereof.

* * * * *